US008899300B2

(12) United States Patent
Daniels

(10) Patent No.: US 8,899,300 B2
(45) **Date of Patent: *Dec. 2, 2014**

(54) ADJUSTABLE ROLLER SHADE

(76) Inventor: Joseph J. Daniels, Roslyn Heights, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/567,326

(22) Filed: Aug. 6, 2012

(65) Prior Publication Data

US 2013/0199739 A1 Aug. 8, 2013

Related U.S. Application Data

(63) Continuation-in-part of application No. 13/098,879, filed on May 2, 2011.

(60) Provisional application No. 61/331,082, filed on May 4, 2010.

(51) Int. Cl.
*A47H 1/00* (2006.01)
*E06B 9/44* (2006.01)

(52) U.S. Cl.
CPC ..... *E06B 9/44* (2013.01)
USPC ..... 160/250; 160/263; 160/238

(58) Field of Classification Search
USPC ..... 160/238, 250, 263, 323.1, 23.1
See application file for complete search history.

(56) References Cited

U.S. PATENT DOCUMENTS

| | | | | |
|---|---|---|---|---|
| 728,424 | A * | 5/1903 | Steffee | 82/70.1 |
| 2,615,516 | A * | 10/1952 | Hyde | 30/123 |
| 3,515,417 | A * | 6/1970 | Bowman | 403/366 |
| 3,521,694 | A * | 7/1970 | Anderson | 160/323.1 |
| 4,092,775 | A * | 6/1978 | Erpenbeck | 30/95 |
| 4,114,266 | A * | 9/1978 | Erpenbeck | 30/123 |
| 4,403,415 | A * | 9/1983 | Kufrin | 30/96 |
| 6,019,864 | A * | 2/2000 | Jones | 156/258 |
| 6,615,895 | B2 * | 9/2003 | Marocco | 160/173 R |
| 6,758,257 | B2 * | 7/2004 | Lee | 160/166.1 |
| 6,880,607 | B2 * | 4/2005 | Marocco | 160/173 R |
| 6,931,970 | B2 * | 8/2005 | Cheng | 82/101 |
| 2007/0277657 | A1 * | 12/2007 | Hilgendorf et al. | 83/13 |
| 2009/0126881 | A1 * | 5/2009 | Chi et al. | 160/368.1 |

* cited by examiner

*Primary Examiner* — Katherine Mitchell
*Assistant Examiner* — Johnnie A Shablack
(74) *Attorney, Agent, or Firm* — Amster, Rothstein & Ebenstein, LLP

(57) ABSTRACT

A roller shade assembly comprises a tubular roller having a generally cylindrical internal cavity, an generally tubular extension telescopically mounted within the internal cavity of the tubular roller, and an outer tube mounted over the extension. The extension includes an outer wall and a plurality of winged splines located around the outer circumference of the outer wall which extend along at least a portion of the length of the extension tube.

14 Claims, 9 Drawing Sheets

ADJUSTABLE ROLLER SHADE

CROSS-REFERENCE TO RELATED APPLICATIONS

This application is a continuation-in-part of U.S. patent application Ser. No. 13/098,879, filed May 2, 2011, which claims priority to U.S. Provisional Patent Application No. 61/331,082, filed May 4, 2010 the contents of which are incorporated herein by reference in their entirety.

FIELD

The present invention relates to window roller shades, and in particular to length adjustable roller shades.

SUMMARY

A method of adjusting length of a roller shade assembly according to an exemplary embodiment of the present invention, where the roller shade assembly comprises: a tubular roller having a generally cylindrical internal cavity; a tubular extension telescopically mounted within the internal cavity of the tubular roller, an end of the tubular extension being disposed outside the internal cavity, wherein the extension comprises an outer wall and a plurality of winged splines located around the outer circumference of the outer wall and which extend along at least a portion of the length of the extension; and an outer tube mounted over the extension, comprises the steps of: cutting the extension to a length which results in desired total length of the roller shade assembly; and sliding the tubular extension into the internal cavity of the tubular roller until the end of the tubular extension is flush with an end of the extension.

In at least one embodiment, the step of cutting is performed using a tube cutting machine.

In at least one embodiment, the tube cutting machine comprises: a base; a top handle pivotally attached to the base; a blade disposed on the top handle; a bottom handle extending from the base; and a workpiece support disposed on the base.

In at least one embodiment, the bottom handle is pivotally attached to the base.

In at least one embodiment, the workpiece support comprises rollers.

In at least one embodiment, the workpiece support is shaped to conform to a shape of the workpiece.

In at least one embodiment, the tube cutting machine further comprises a workpiece guide disposed on the top handle.

A roller shade assembly according to an exemplary embodiment of the present invention comprises: a tubular roller having a generally cylindrical internal cavity; a tubular extension telescopically mounted within the internal cavity of the tubular roller, an end of the tubular extension being disposed outside the internal cavity, wherein the extension comprises an outer wall and a plurality of winged splines located around the outer circumference of the outer wall and which extend along at least a portion of the length of the extension; and an outer tube mounted over the extension.

In at least one embodiment, each of the winged splines comprises first and second members splayed outward in opposing directions from a common center point on the outer wall.

In at least one embodiment, the first and second members have a curved cross-sectional contour.

In at least one embodiment, the first and second members are substantially resiliently flexible.

In at least one embodiment, the resiliently flexible first and second members provide for a tight frictional fit that resists lengthwise movement and relative rotation between the extension and the roller, while allowing the extension to slide lengthwise within the roller when under compressive force.

In at least one embodiment, the resiliently flexible first and second members allows for the extension to be adaptable for insertion into rollers of varying diameters.

In at least one embodiment, the plastic extension is substantially rigid along its length to provide stability to the outer tube.

In at least one embodiment, the roller and the outer tube define a substantially continuous single-diameter contour.

These and other features of this invention are described in, or are apparent from, the following detailed description of various exemplary embodiments of this invention.

BRIEF DESCRIPTION OF THE DRAWINGS

Exemplary embodiments of this invention will be described with reference to the accompanying figures.

DETAILED DESCRIPTION

Figure 1:
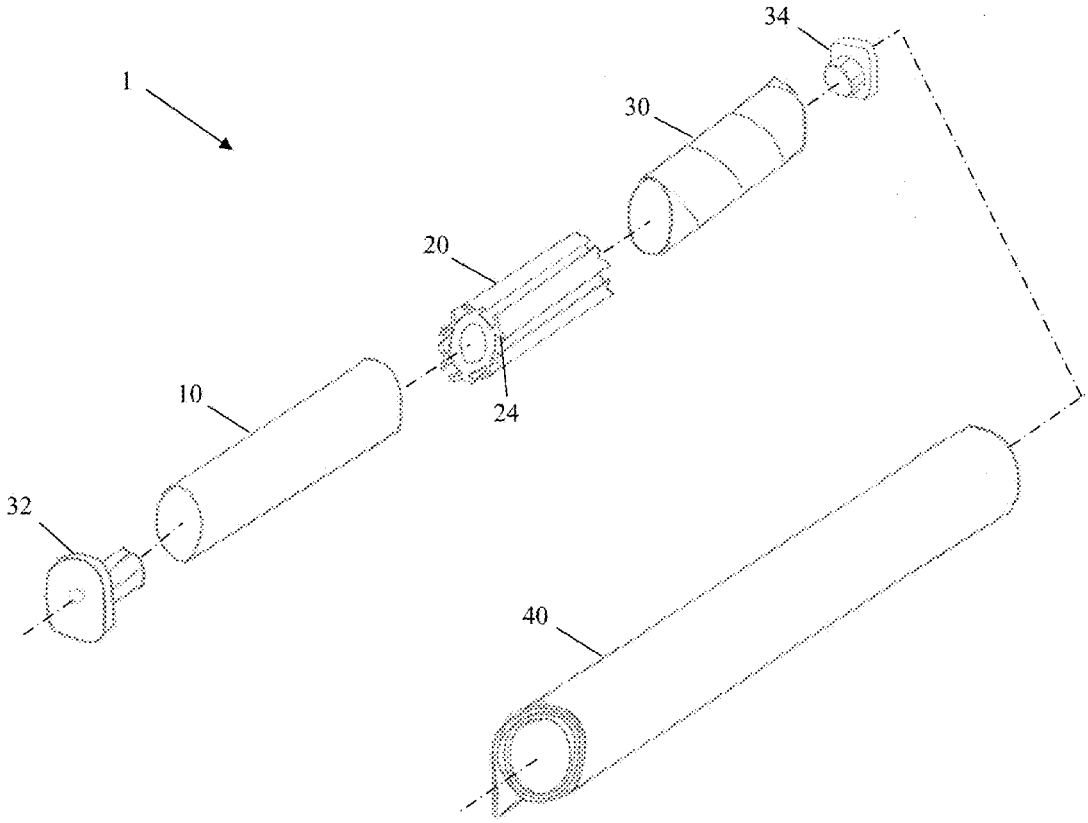
FIG. 1 is an exploded view of the roller shade assembly according to an example embodiment.

The description hereinafter describes exemplary embodiments of a telescoping, cut-to-size roller shade system in conjunction with the accompanying figures. Where possible, like numerals are used to denote like components.

Referring to FIGS. 1-5, the roller shade system, generally designated by reference number 1, includes a hollow, tubular roller 10 that extends for the majority of the length of the shade. A generally tubular extension 20 is telescopically inserted into one end of the roller 10 to extend the length of the roller 10 to match the length of the shade. The portion of the extension 20 that extends beyond the roller 10 is surrounded by an outer tube 30, which may be fixed or rotatable relative to the extension 20. The extension 20 acts to provide strength and stability to the outer tube 30. The diameter of the outer tube 30 and the roller 10 are approximately the same, thereby providing a continuous single-diameter contour along the length of the shade. A fabric shade 40 is wrapped around the fully assembled roller assembly.

Figure 2A:
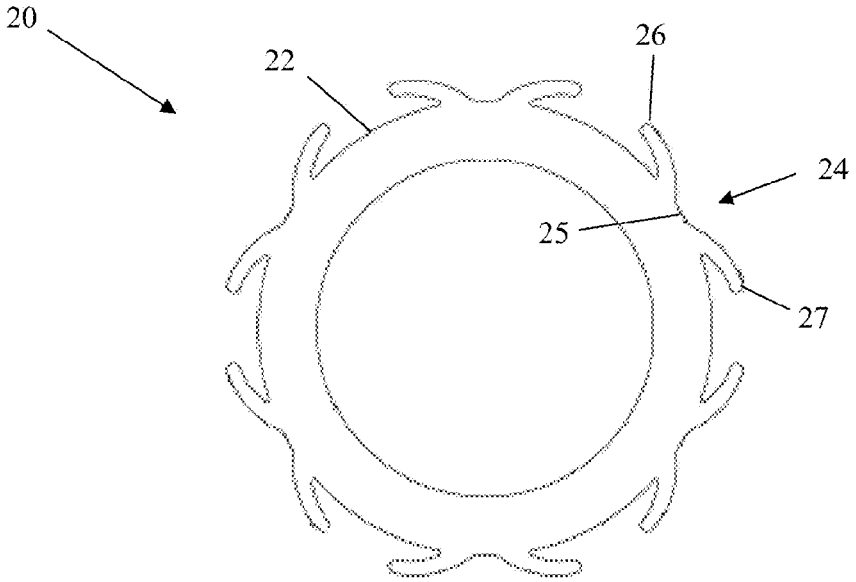
FIG. 2A is cross-section of an extension for the roller according to an example embodiment.

FIG. 2A is a cross-sectional view of the extension according to an example embodiment. According to this embodiment, the extension 20 includes an outer wall 22 of a generally uniform thickness and a plurality of winged splines 24 located around the outer circumference. The splines 24 can extend substantially along the entire length of the extension 20, but may also extend along only a portion thereof. Each spline 24 comprises first and second members 26, 27 splayed outward from a common center point 25 on the outer wall 22.

Figure 2B:
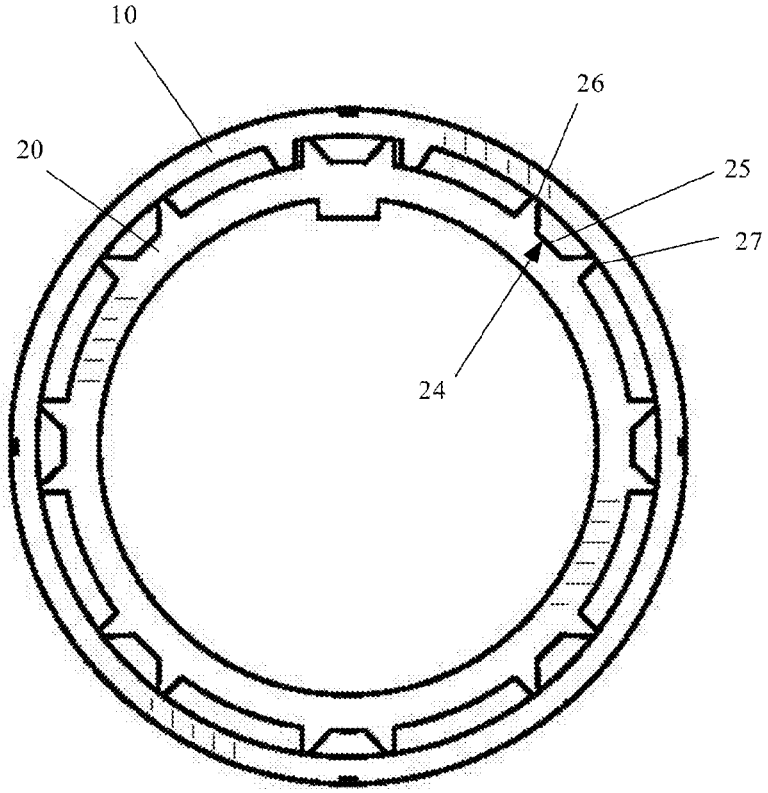
FIG. 2B is a cross-section of an extension of the roller according to an example embodiment.

As shown in FIG. 2B, in another exemplary embodiment, the splines 24 may include first and second members 26, 27 that do not splay outward from the common center point 25, but instead extend substantially straight out from the outer wall 22 around the comment center point 25. The inner wall of the roller 10 may include at least one pair of extensions that are adapted to receive a corresponding spline 24 so as to prevent the extension 20 from rotating relative to the roller 10. In various exemplary embodiments, the splines 24 may have any suitable shape, such as, for example, square, semicircular or otherwise curved or pointed.

The first and second members 26, 27 are designed to be resiliently flexible, which provides for a tight frictional fit that resists lengthwise movement and relative rotation between the extension 20 and the roller 10, while still allowing the extension 20 to slide lengthwise within the roller 10 when under deliberate, intentionally-applied compressive forces. The flexibility of the first and second members 26, 27 also allows the extension 20 to be inserted into rollers 10 of varying diameters. Factors contributing to the flexibility of the first and second members 26, 27 may include the type of material used, the thickness, and the curved contour of the members.

The roller 10 may be formed from a sturdy, rigid material, such as plastic, metal or the like. The extension 20 may be formed from a sturdy material, such as plastic, an elastomer, metal or the like. For example, the extension 20 may be an extruded tube of chlorinated polyvinyl chloride (CPVC) type thermoplastic, UL rated 94 VO so as to provide sufficient structural rigidity for the outer wall 22 and flexibility for the splines 24. The outer tube 30 may be formed from cardboard, plastic, an elastomer, sheet metal, extruded metal or the like. For example, the outer tube 30 may be made of a thin layer of cardboard or plastic for reasons of economy, ease of manufacturing, and ease of cutting to adjust to the appropriate length.

To adjust the length of the roller shade assembly, the outer tube 30 is measured to the necessary length and then placed in a window shade cutter, such as a window shade cutting machine manufactured by Star Shade Cutter Co., Inc, of St. Joseph, Mich., USA.

Figure 6A:
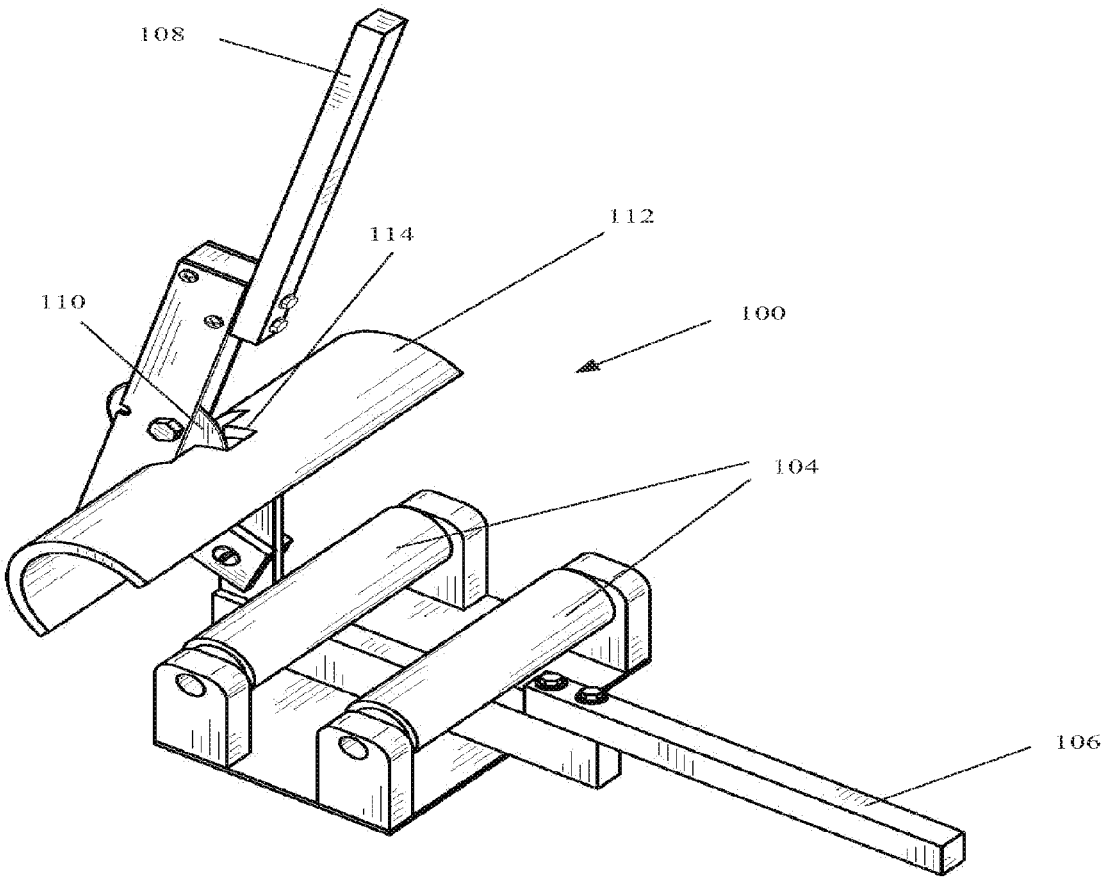
FIG. 6A is a perspective view of an outer tube cutting machine according to an exemplary embodiment of the present invention.
Figure 6B:
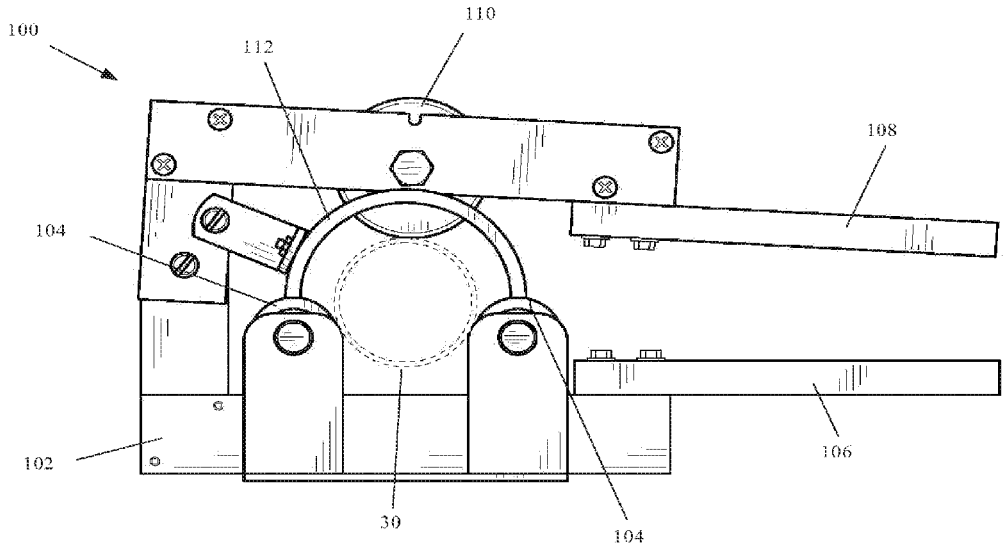
FIG. 6B is a side view of the outer tube cutting machine shown in FIG. 6A.
Figure 7A:
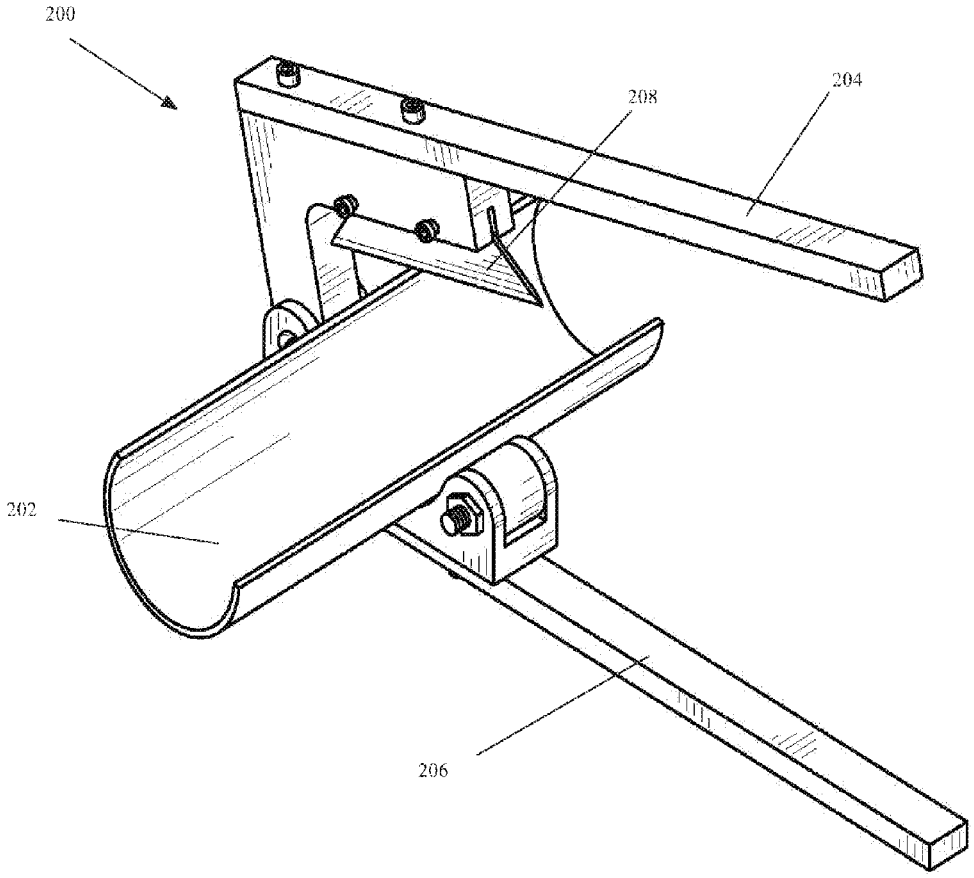
FIG. 7A is a perspective view of an outer tube cutting machine according to an exemplary embodiment of the present invention.
Figure 7B:
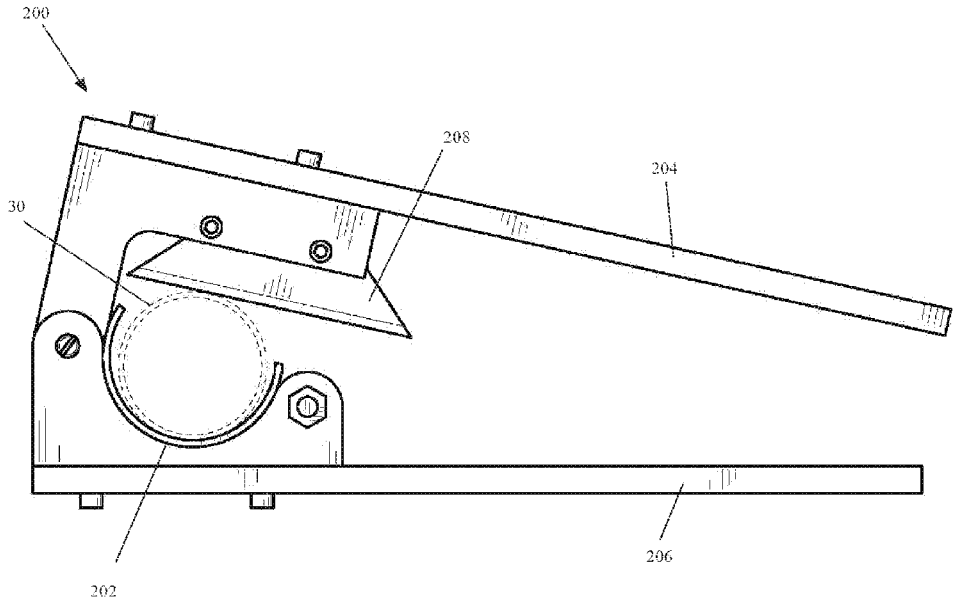
FIG. 7B is a side view of the outer tube cutting machine shown in FIG. 7A.

FIGS. 6 and 7 show outer tube cutting machines according to exemplary embodiments of the present invention. In particular, as further described below, FIGS. 6A and 6B show an outer tube cutting machine having a round blade and FIGS. 7A and 7B show an outer tube cutting machine having a straight blade. Although referred to as "tube cutting machines", it should be appreciated that the machines can be used to cut any type of material and/or object.

FIG. 6A is a perspective view of an outer tube cutting machine, generally designed by reference number 100, according to an exemplary embodiment of the present invention. The cutting machine 100 includes a base 102 on which are mounted workpiece support rollers 104 and bottom handle 106. A top handle 108 is pivotally supported by the base 102. The top handle 108 carries a circular blade 110 and a workpiece guide 112 having an opening 114. The workpiece guide 112 may be generally cylindania-shaped so as to conform to the shape of the workpiece, which in this case is the outer tube 30. However, is should be appreciated that the workpiece guide 112 may have any other suitable shape. As shown in FIG. 6B, when the top handle 108 is pivoted downwards, the circular blade 110 extends through the opening 114 and cuts into the workpiece. The workpiece can be rotated with the aid of the support rollers 104 so that the circular blade 110 cuts around the circumference of the workpiece. It should be appreciated that any other blade shape may be used in this exemplary embodiment.

FIG. 7A is a perspective view of an outer tube cutting machine, generally designated by reference number 200, according to another exemplary embodiment of the present invention. The cutting machine 200 includes a workpiece support 202 to which a top handle 204 and a bottom handle 206 are pivotally attached. The top handle 204 carries a straight blade 208. The workpiece support 202 may be generally cylindania-shaped so as to conform to the shape of the workpiece, which in this case is the outer tube 30. However, is should be appreciated that the workpiece support 202 may have any other suitable shape. As shown in FIG. 7B, when the top handle is pivoted downwards, the straight blade 208 cuts into the workpiece. The workpiece can be rotated with the aid of the workpiece support 202 so that the straight blade 208 cuts around the circumference of the workpiece. It should be appreciated that any other blade shape may be used in this exemplary embodiment.

The cutting machines described above with reference to FIGS. 6 and 7 have a fixed blade so that the workpiece may be rotated relative to the blade. However, it should be appreciated that in other exemplary embodiments, the workpiece may be fixed using, for example, a clamping device, and the blade may be rotated around the workpiece to create the cut.

Typically, the cutting blade of the shade cutter is fixed and the outer tube 30 is rotated such that the cutting blade moves around the outer tube 30. It is intended that the cutting blade slices off only the excess portion of the outer tube 30, and not the extension 20. The cutting blade may inadvertently make initial contact with the outer tips of the first and second members 26, 27 of the splines 24, yet given the structure of the extension 20, the splines 24 will act as a warning to the operator to stop the cutting operation. This allows the structural integrity and rigidity of the extension 20 to remain uncompromised after the cutting operation is complete. The extension 20 is preferably made from a softer material such as plastic or an elastomer, which will reduce or prevent damage from occurring to the cutting blade when cuts through the thin outer tube 30 and comes in contact with the more substantial extension 20.

Figure 3:
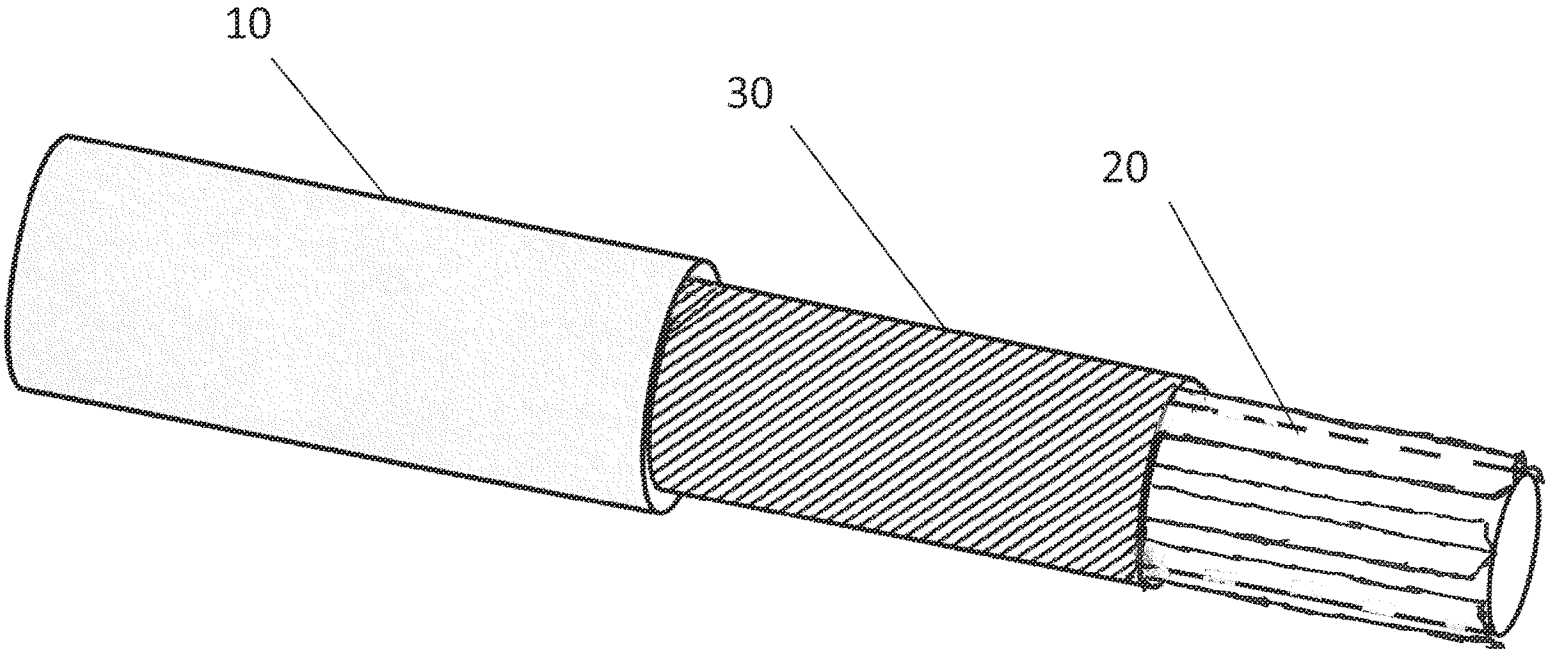
FIG. 3 is a perspective view showing the extension extending beyond the outer tube according to an example embodiment.
Figure 4:
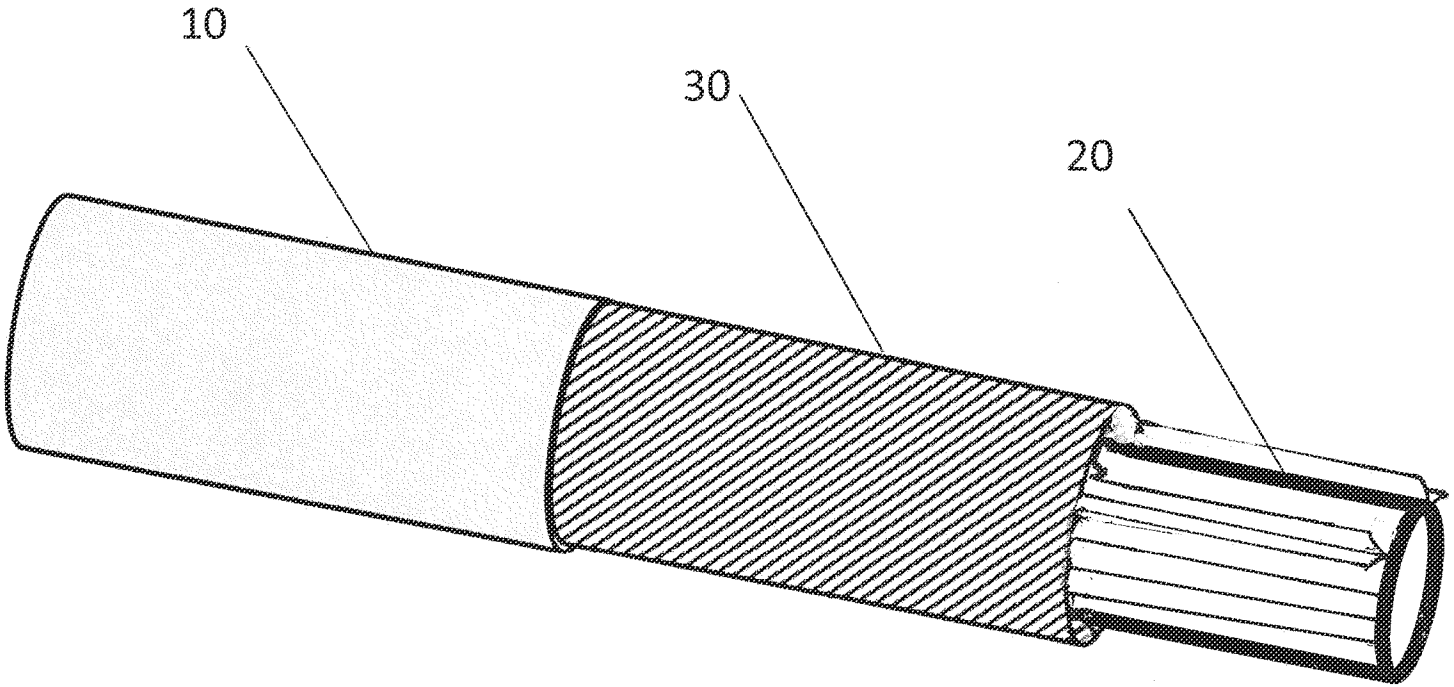
FIG. 4 is a perspective view showing the extension aligned flush with the outer tube according to an example embodiment.
Figure 5:
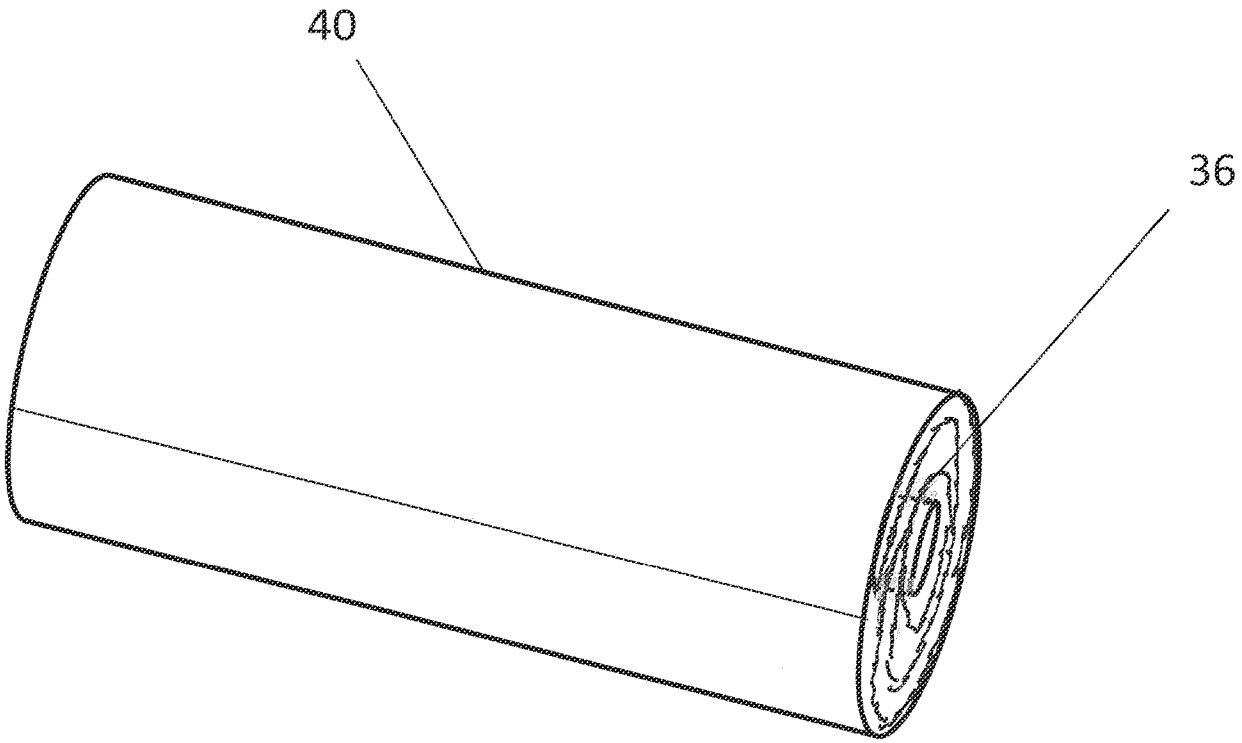
FIG. 5 is a perspective view of a fully assembled roller shade system according to an example embodiment.

After the outer tube 30 is cut to the appropriate length, a portion of the extension 20 will be left extending beyond the end of the outer tube such as shown in FIG. 3. The extension 20 can be slid further into the roller 10 until the end of the extension 20 is flush with the end of the outer tube 30 such as shown in FIG. 4. The fabric shade 40 is wrapped around the fully assembled roller shade assembly as shown in FIG. 5.

A clutch 32 and/or idler 34 may be inserted directly into the hollow cavities of the roller 10 and extension 20, respectively, in which case the inner surface defining the hollow cavities may be keyed to for rotational engagement with the clutch or idler such as shown in FIG. 1. The clutch 32 may be, for example, spring, motor or gear/crank operated. A pin-bearing end cap 36 may alternatively be inserted into the hollow cavity at the exposed ends of the extension 20 in order to engage the roller shade assembly directly with a bracket that is used for mounting such as shown in FIG. 5. A lift mechanism (not shown) may be inserted into either the roller 10 or, at the opposite end, the extension 20 so that the shade can be used with the lift mechanism on the left or right side. An adapter may be used to step down the internal diameter of the lift mechanism to the same as that of the extension 20.

Now that exemplary embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

What is claimed is:

1. A method of adjusting a length of a roller shade assembly, the roller shade assembly comprising:

a tubular roller having a generally cylindrical internal cavity;

a tubular extension telescopically mounted within the internal cavity of the tubular roller, an end of the tubular extension being disposed outside the internal cavity, wherein the extension comprises an outer wall and a plurality of winged splines located around an outer circumference of the outer wall, the plurality of winged splines extending along at least a portion of a length of the extension, each winged spline of the plurality of winged splines comprises first and second members that form an acute angle with respect to the outer circumference of the outer wall; and an outer tube mounted over the extension, the method comprising the steps of:

cutting the extension to a desired length; and sliding the tubular extension into the internal cavity of the tubular roller until an end of the tubular extension is flush with an end of the outer tube.

2. The method of claim 1, wherein the step of cutting is performed using a tube cutting machine.

3. The method of claim 2, wherein the tube cutting machine comprises:

a base;

a top handle pivotally attached to the base;

a blade disposed on the top handle;

a bottom handle extending from the base; and a workpiece support disposed on the base.

4. The method of claim 3, wherein the workpiece support comprises rollers.

5. The method of claim 3, wherein the workpiece support is shaped to conform to a shape of the workpiece.

6. The method of claim 3, wherein the tube cutting machine further comprises a workpiece guide disposed on the top handle.

7. A roller shade assembly comprising:

a tubular roller having a generally cylindrical internal cavity;

a tubular extension telescopically mounted within the internal cavity of the tubular roller, an end of the tubular extension being disposed outside the internal cavity, wherein the extension comprises an outer wall and a plurality of winged splines located around an outer circumference of the outer wall, the plurality of winged splines extending along at least a portion of a length of the extension, each winged spline of the plurality of winged splines comprises first and second members that form an acute angle with respect to the outer circumference of the outer wall; and an outer tube mounted over the extension.

8. The roller shade assembly of claim 7, wherein the tubular extension is substantially rigid along its length to provide stability to the outer tube.

9. The roller shade assembly of claim 7, wherein the tubular roller and the outer tube define a substantially continuous single-diameter contour.

10. The roller shade assembly of claim 7, wherein the first and second members are splayed outward in opposing directions from a common center point on the outer wall.

11. The roller shade assembly of claim 10, wherein the first and second members have a curved cross-sectional contour.

12. The roller shade assembly of claim 10, wherein the first and second members are substantially resiliently flexible.

13. The roller shade assembly of claim 12, wherein the resiliently flexible first and second members provide for a tight frictional fit that resists lengthwise movement and relative rotation between the extension and the roller, while allowing the extension to slide lengthwise within the roller when under compressive force.

14. The roller shade assembly of claim 12, wherein the resiliently flexible first and second members allows for the extension to be adaptable for insertion into rollers of varying diameters.

* * * * *